US006511159B1

(12) United States Patent
Suzuki et al.

(10) Patent No.: US 6,511,159 B1
(45) **Date of Patent: *Jan. 28, 2003**

(54) INK JET RECORDING APPARATUS AND RECORDING METHOD

(75) Inventors: Akio Suzuki, Yokohama (JP); Nobuhiko Ogata, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/861,003

(22) Filed: May 21, 1997

Related U.S. Application Data

(63) Continuation of application No. 08/311,494, filed on Sep. 23, 1994, now abandoned.

(30) Foreign Application Priority Data

Sep. 24, 1993 (JP) ..... 5-238020

(51) Int. Cl.[7] ..... B41J 2/05
(52) U.S. Cl. ..... 347/60; 347/9
(58) Field of Search ..... 347/60, 57, 14, 347/9

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,712,172 A | * | 12/1987 | Kiyohara | 347/60 |
| 4,723,129 A | | 2/1988 | Endo et al. | |
| 4,740,796 A | | 4/1988 | Endo et al. | |
| 4,982,199 A | * | 1/1991 | Dunn | 347/60 X |
| 5,109,234 A | * | 4/1992 | Otis | 347/60 X |
| 5,132,702 A | * | 7/1992 | Shiozaki | 347/12 |
| 5,157,411 A | * | 10/1992 | Takekoshi | 347/57 X |
| 5,168,284 A | * | 12/1992 | Yeung | 347/60 X |
| 5,172,134 A | * | 12/1992 | Kishida | 347/13 |
| 5,225,849 A | * | 7/1993 | Suzuki | 347/12 X |
| 5,276,459 A | | 1/1994 | Danzuka et al. | |
| 5,285,220 A | | 2/1994 | Suzuki et al. | |
| 5,300,969 A | * | 4/1994 | Miura | 347/60 X |
| 5,302,971 A | | 4/1994 | Ohba et al. | |
| 5,339,098 A | | 8/1994 | Nagatomo et al. | |
| 5,381,164 A | * | 1/1995 | Ono | 347/13 X |
| 5,594,478 A | * | 1/1997 | Matsubara et al. | 347/14 X |
| 5,598,190 A | * | 1/1997 | Yoshida | 347/13 |
| 5,606,355 A | * | 2/1997 | Komatsu | 347/60 |
| 5,808,632 A | * | 9/1998 | Miura | 347/60 X |
| 5,894,314 A | * | 4/1999 | Tajika | 347/60 X |

FOREIGN PATENT DOCUMENTS

| | | | |
|---|---|---|---|
| JP | 54-56847 | 5/1979 | B41M/5/26 |
| JP | 58-187364 | 11/1983 | B41J/3/04 |
| JP | 58-187464 | 11/1983 | B41J/3/04 |
| JP | 59-138461 | 4/1984 | B41J/3/04 |
| JP | 59-123670 | 7/1984 | B41J/3/04 |
| JP | 60-71260 | 4/1985 | B41J/3/04 |
| JP | 2-3326 | 1/1990 | B41J/2/205 |
| JP | 2-25338 | 1/1990 | B41J/2/13 |
| JP | 2-219659 | 9/1990 | B41J/2/21 |
| JP | 2-265749 | 10/1990 | B41J/2/01 |

* cited by examiner

*Primary Examiner*—Benjamin R. Fuller
(74) *Attorney, Agent, or Firm*—Fitzpatrick, Cella, Harper & Scinto

(57) ABSTRACT

In a normal record mode, a non-heat mode such that a non-ejecting pulse for heating is not supplied when the image recording is not executed is set. In a continuous magnify-record mode, a heat mode such that the non-ejecting pulse for heating is supplied when the image recording is not executed is set. Thus, a non-uniformity of an image density at the start and end of the recording can be suppressed and a reduction of the life of the head can be minimized.

29 Claims, 13 Drawing Sheets

INK JET RECORDING APPARATUS AND RECORDING METHOD

This application is a continuation of application Ser. No. 08/311,494, filed Sep. 23, 1994, now abandoned.

BACKGROUND OF THE INVENTION

1. Field of the Invention

The invention relates to an ink jet recording apparatus and a recording method and, more particularly, to an ink jet recording apparatus and a recording method for recording by performing a serial scan.

2. Related Background Art

The ink jet recording apparatus has advantages such that a mechanism is simple, it can be easily constructed in a compact size, a color image can be easily formed, and the like, so that it has rapidly been spread in recent years. Although an image formed by such an apparatus is extremely stable for a fluctuation in humidity, there is a problem such that an image density easily fluctuates in the case where the temperature fluctuates. This is because a viscosity of ink changes depending on the temperature, so that an ink ejection amount changes. For example, when the temperature rises, the viscosity of ink decreases, so that the ejection amount increases. When the temperature decreases, the viscosity of ink increases, so that the ejection amount decreases on the contrary.

Among the ink jet recording apparatuses, an apparatus of what is called a bubble jet system in which an electrothermal transducer is heated, the ink is boiled and the ink is ejected out by its pressure, has advantages such that multi-nozzles can be easily formed, a high density can be easily realized and the like. The above system, however, also has a problem such that a density fluctuation is large because of an increase in temperature due to a heat generation of the electrothermal transducer. After the printing is started, the temperature of head gradually rises. Therefore, as the printing operation is continuously executed, the image density increases rather than that just after the start of the printing. After the printing operation was stopped, the density again decreases.

As a method of suppressing a density fluctuation due to an increase in head temperature in the bubble jet system, there is a method of increasing the head temperature by heating the electrothermal transducer by a pulse or voltage having such a width or level as not to eject out the ink. By executing such a heating process before the printing, the image density just after the printing rises and a difference between such a density and the image density when the printing is continued is reduced.

On the other hand, among image recording apparatuses in which a bubble jet head is serially scanned and an image is recorded, there is known an apparatus in which output images are combined and an image of a large area is formed. FIG. 3 shows a state in which a part of a capital letter "A" is printed to each of four papers of the Al size by such a recording apparatus and those four papers are combined. In the diagram, "A" is drawn as a voided image on a blue background. A mode to obtain an image of a large area by combining a plurality of papers is hereinafter referred to as a "continuous magnify-record mode". In the diagram, a P direction indicates a main scanning direction of the recording head and an f' direction indicates a subscanning direction of the recording head.

Among the output images (1) to (4), an image density at a start point of the scan in the P direction is low. A temperature rises in association with the printing operation and the image density also rises and is highest at an end point of the scan. When the printing of one scan is finished, the head doesn't perform the printing operation and is returned in the direction opposite to the P direction. At this time, the head temperature decreases and the image density is again reduced at the start point of the next scan. Therefore, a difference of the image densities occurs in the end point portion of the scan of (1) and the start point portion of the scan of (2). In dependence on an original, an optical density difference of 0.2 or more occurs.

Further, since the start and end points of the scan are finally located at neighboring positions, a small image density difference becomes very conspicuous. Actually, even when the density difference between (1) –S and (1) –E is equal to about 0.2, it is inconspicuous so long as only one paper of (1) is seen. However, in the neighboring portions of (1) –E and (2) –S, even when there is a density difference of 0.1, it is visually very conspicuous.

Therefore, in order to make the image density difference visually inconspicuous in the continuous magnify-record mode, it is insufficient to merely give a pulse of a duration such as not to eject the ink just before the start of the printing. Particularly, in the case where a scan length in the P direction is set to a large value in order to obtain an image of a large area, the head temperature in one scan largely increases, so that the above problem becomes remarkable.

To prevent such a problem, a method whereby not only a pulse for heating the head is given just before the start of the printing but also such a pulse is positively given is considered. However, when the head is excessively heated, there is a case where the life of head is reduced. Although there are various structures of the print head, generally, a nozzle and a top plate or a nozzle and a board of the heater are adhered. In such a case, when a heat pulse is excessively applied, a problem such that a temperature of adhesive agent too rises and the adhesive agent is peeled off occurs.

SUMMARY OF THE INVENTION

It is an object of the invention to provide ink jet recording apparatus and recording method which can suppress a fluctuation of an image density due to a temperature fluctuation, for example, a fluctuation of an image density at the start of the recording and the end of the recording.

Another object of the invention is to provide ink jet recording apparatus and method which can minimize a reduction of life of a head.

According to one aspect of the present invention, the above objects are accomplished by an ink jet recording apparatus for recording an image by using a recording head which ejects an ink by a heat generation of an electrothermal transducer, wherein the apparatus comprises: supplying means for supplying a heating signal under conditions such as not to eject the ink to the electrothermal transducer; selecting means for selecting conditions to supply the heating signal; and control means for controlling the supplying means in accordance with the result of the selection of the conditions of the selecting means.

According to another aspect of the invention, the above objects are also accomplished by an ink jet recording apparatus in which a recording head that is constructed by arranging a plurality of ejecting portions each for ejecting an ink by a heat generation of an electrothermal transducer is repetitively scanned in the direction different from the arranging direction of the ejecting portions, thereby recording an image, wherein the apparatus comprises: supplying means for supplying a heating signal under conditions such as not to eject the ink to the electrothermal transducer; selecting means for selecting conditions to supply the heating signal; correcting means for correcting an amount of ink that is ejected to a boundary portion of the image to be recorded by the scan; and control means for controlling the supplying means in accordance with the result of the selection of the conditions of the selecting means and for controlling a correction amount by the correcting means in the scan.

According to still another aspect of the invention, the above objects are accomplished by an ink jet recording method of recording an image by using a recording head to eject an ink by a heat generation of an electrothermal transducer, wherein the method comprises: a setting step of setting conditions to supply a heating signal under conditions such as not to eject the ink to the electrothermal transducer; a heating signal supplying step of supplying the heating signal to the electrothermal transducer in accordance with the set conditions when the image recording is not executed; and an ejecting signal supplying step of supplying an ejecting signal under conditions such as to eject the ink to the electrothermal transducer when the image is recorded.

According to further another aspect of the invention, the above objects are accomplished by an ink jet recording method in which a recording head which is constructed by arranging a plurality of ejecting portions each for ejecting an ink by a heat generation of an electrothermal transducer is repetitively scanned in the direction different from the arranging direction of the ejecting portions, thereby recording an image, wherein the method comprises: a setting step of setting conditions to supply a heating signal under conditions such as not to eject the ink to the electrothermal transducer; a correcting step of correcting an amount of ink that is ejected to a boundary portion of the image to be recorded by the scan on the basis of a correction amount according to the set conditions; a heating signal supplying step of supplying the heating signal to the electrothermal transducer in accordance with the set conditions; and an ejecting signal supplying step of supplying an ejecting signal under conditions to eject the ink to the electrothermal transducer when the image is recorded.

According to the above construction, since the heating signal can be supplied in accordance with the condition to supply the heating signal, the reduction of the life of the head can be minimized and a uniformity of the density can be sufficiently assured as necessary.

DETAILED DESCRIPTION OF THE PREFERRED EMBODIMENTS

Embodiments of the invention will now be described in detail hereinbelow with reference to the drawings.

Embodiment 1

Figure 1:
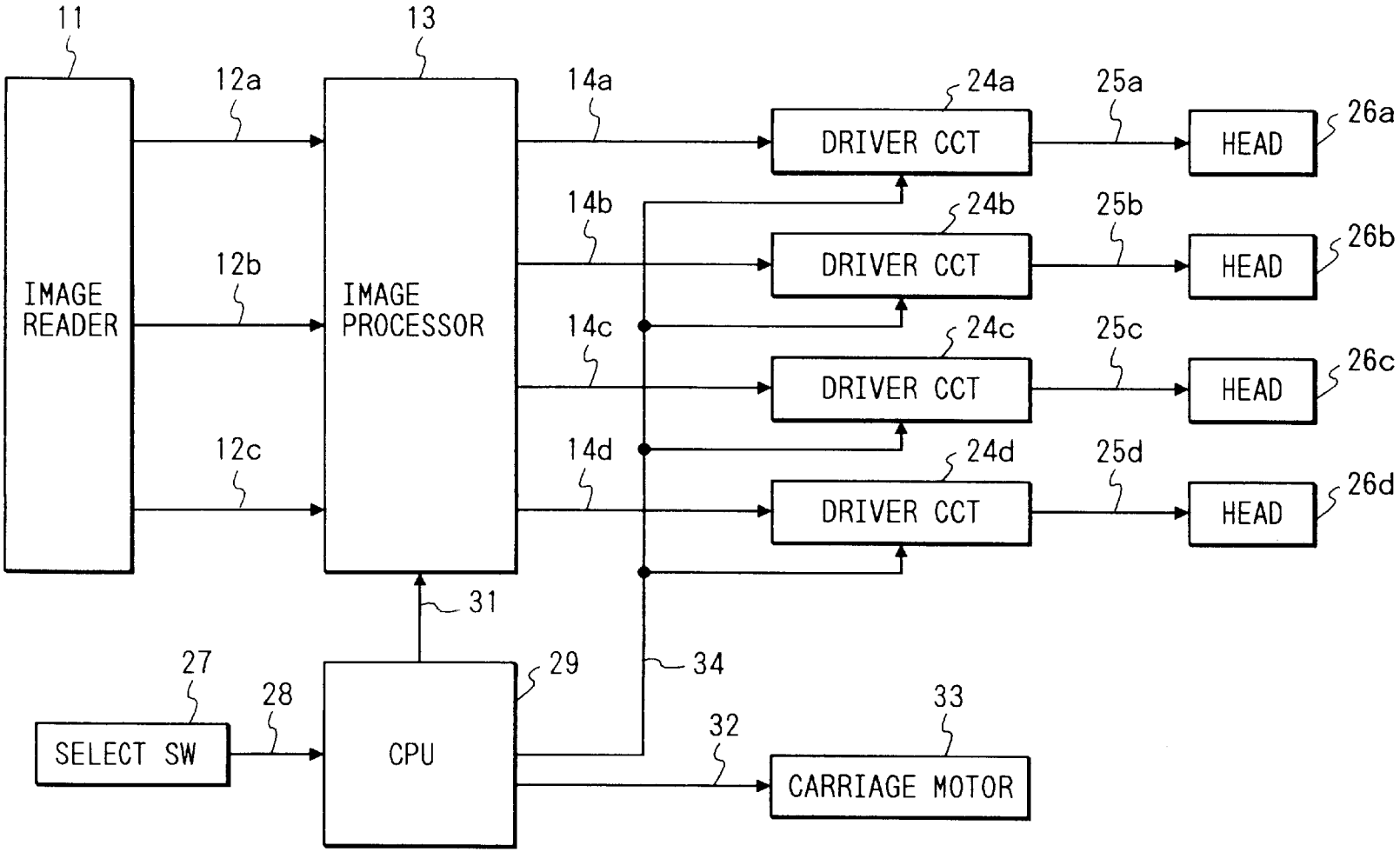
FIG. 1 is a block diagram of an embodiment 1 of the invention.

FIG. 1 is a control block diagram showing an embodiment 1 of the invention. Reference numerals 12*a*, 12*b*, and 12*c* denote image signals of red (R), green (G), and blue (B) which are sent from an original image reader 11 or a computer. Reference numeral 13 denotes an image processor for executing image processes such as logarithm conversion, black extraction, UCR, masking, and the like; 14*a* to 14*d* image signals of cyan (C), magenta (M), yellow (Y), and black (Bk) which are generated from the image processor; 24*a* to 24*d* head driver circuits for generating pulses 25*a* to 25*d*; 26*a* to 26*d* heads of cyan, magenta, yellow, and black; 27 a copy mode selecting switch for selecting one of the normal copy mode and the continuous magnify-record mode; 28 a selecting signal (a); 29 a CPU; 31 an image control signal; 34 a drive control signal; 32 a carriage motor control signal; and 33 a carriage motor.

In the normal copy mode, each of the driver circuits 24*a* to 24*d* generates a pulse of a voltage 25V and a width 10 μsec only when the image signal is input. Each of the heads 26*a* to 26*d* heats an electrothermal transducer by such a pulse and causes a film boiling of the ink, thereby ejecting the ink.

Figure 2:
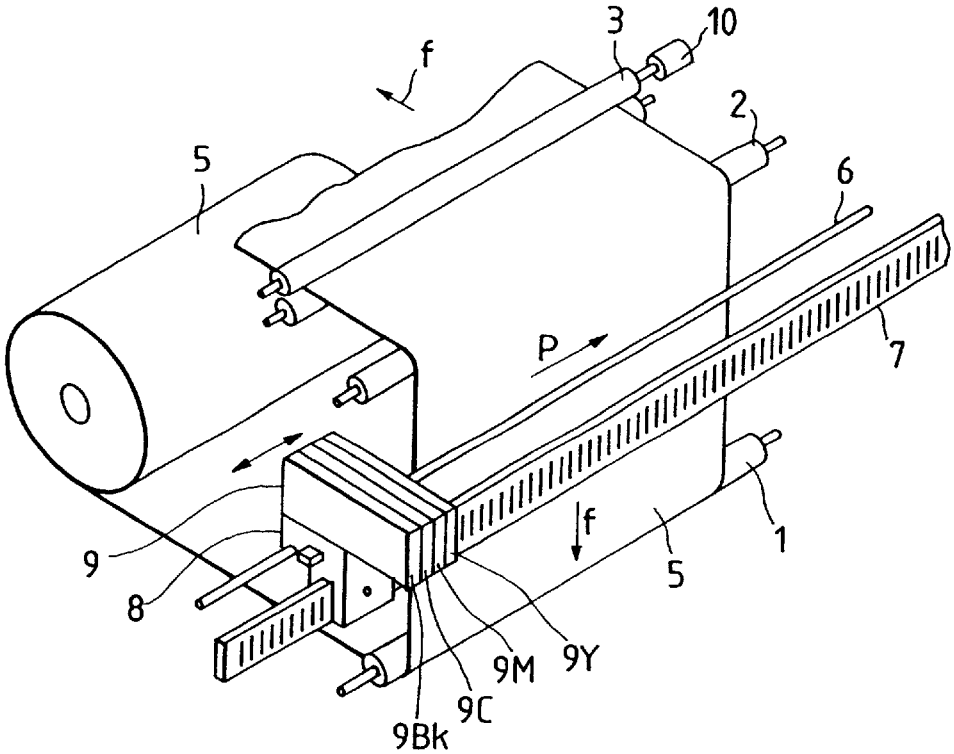
FIG. 2 is a schematic perspective view of a printer which is used in the embodiment of the invention.

FIG. 2 is a perspective view of such a recording apparatus. In the diagram, a recording material 5 wound like a roll is conveyed by conveying rollers 1 and 2 and is sandwiched by a feed roller 3 and is sent in an (f) direction in association with the driving of a subscanning motor 10 coupled with the feed roller 3. Guide rails 6 and 7 are disposed in parallel so as to traverse the recording material. A recording head unit 9 mounted on a carriage 8 is reciprocated to the right and left along the guide rails 6 and 7. Heads 9Y to 9Bk (corresponding to 26*a* to 26*d* in FIG. 1) of four colors of yellow, magenta, cyan, and black are installed on the carriage 8. Ink tanks of four colors are attached to those heads, respectively. The recording material 5 is intermittently fed by a length corresponding to a print width of the head 9 at a time. While the recording material 5 is stopped, the head is scanned (main scan) in the P direction and ejects an ink droplet according to the image signal. The number of nozzles of the head is set to 256 and a recording density is set to 400 dots/inch (dpi). A print width in the (f) direction is set to 16.256 mm. A print width in the P direction is set to 594 mm.

Figure 4:
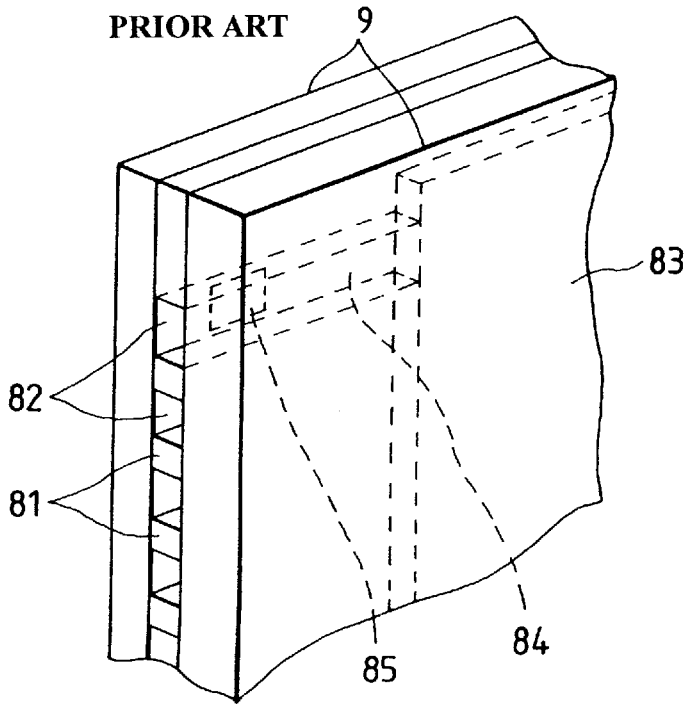
FIG. 4 PRIOR ART
FIG. 4 is a schematic diagram of a printing head which is used in the embodiment of the invention.

FIG. 4 is a partial perspective view showing schematically a structure of an ink ejecting portion of the recording head 9 of a printer 23. In the diagram, a plurality of ejection outlets 82 are formed at a predetermined pitch in an ejection outlet surface 81 which faces the recording material 5 at a predetermined gap. An electrothermal transducer 85 to generate an energy for ejecting the ink is provided along the wall surface of each liquid passage 84 communicating a common liquid chamber 83 and each ejection outlet 82. In the embodiment, the recording head 9 is installed in such a direction that the ejection outlets 82 are arranged so as to perpendicularly cross the scanning direction of the carriage 8. On the basis of the image signal or ejecting signal, the corresponding electrothermal transducer 85 is driven and a film boiling is caused in the ink in the liquid passage 84, thereby ejecting the ink from the ejection outlet 82 by a pressure that is generated in this instance.

Figures 5A, 5B, 5C:
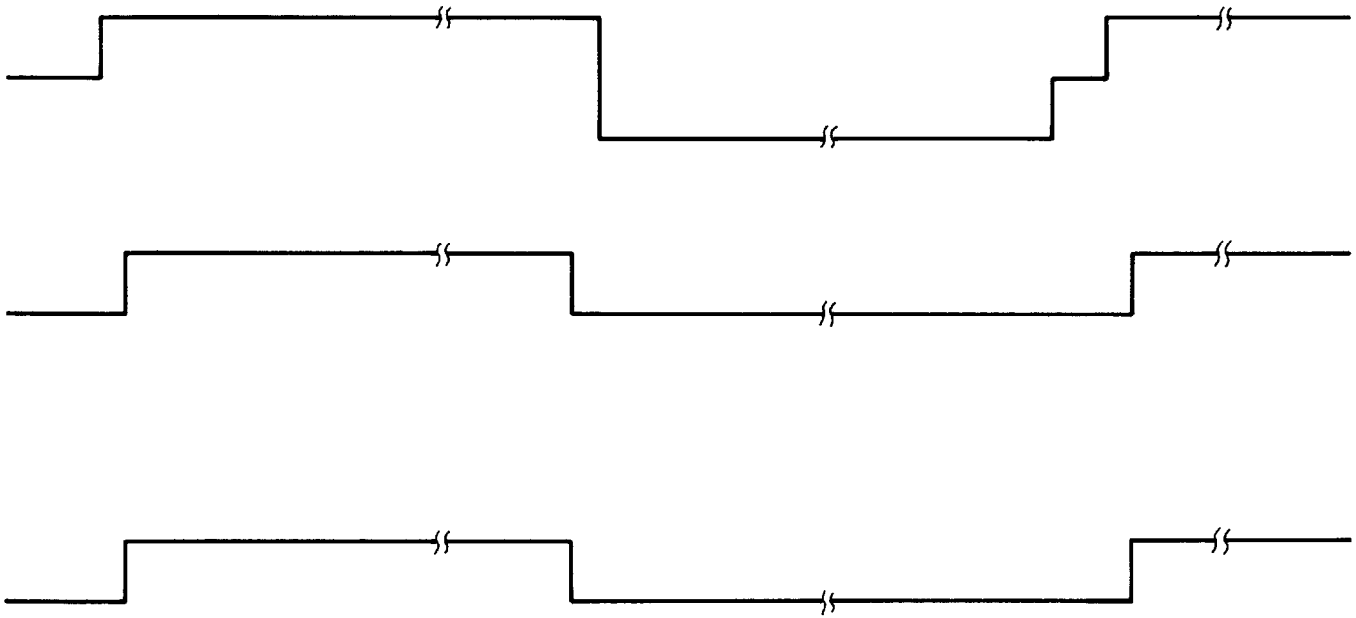
FIGS. 5A to 5C are timing charts each showing a sequence in a normal mode in the invention.
Figure 6A:
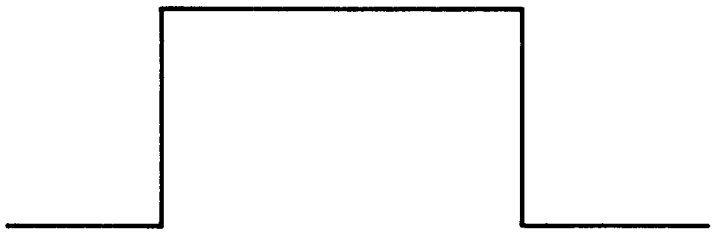
FIGS. 6A to 6C are diagrams showing pulse waveforms which are used in the invention.

FIGS. 5A to 5C are timing charts for various control signals shown in FIG. 1. FIG. 5A shows a control signal of the carriage motor 33. The carriage is scanned in the P direction by a positive signal and is scanned in the direction opposite to the P direction by a negative signal. FIG. 5B shows the image control signal 31. Only when the image control signal 31 is ON, the image signals 14*a* to 14*d* are generated. FIG. 5C shows the drive control signal 34. When the drive control signal 34 is positive, the head driving pulse becomes a pulse suitable for ejection of the ink as shown in FIG. 6A. Although its conditions differ depending on the head, in case of the embodiment, conditions such that the voltage is set to 25V and the pulse width is set to 10 μsec are set as mentioned above.

The carriage motor 33 repeats the forward and reverse rotations, so that the carriage 8 executes the reciprocating operation. When the head reaches the position which faces the recording region of a recording paper, the image control signal 31 is turned on and an image is recorded. Each of the head driver circuits 24*a* to 24*d* is constructed so as to generate the pulse suitable for ejection of the ink only when the drive control signal 34 is positive. Such a pulse is generated only when the image is recorded. A normal copy image is formed by such a sequence.

Figure 6B:
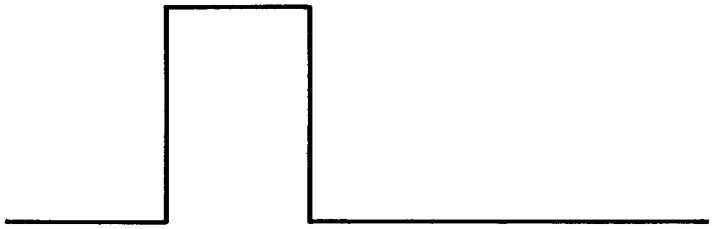
Figures 7A, 7B, 7C, 7D:
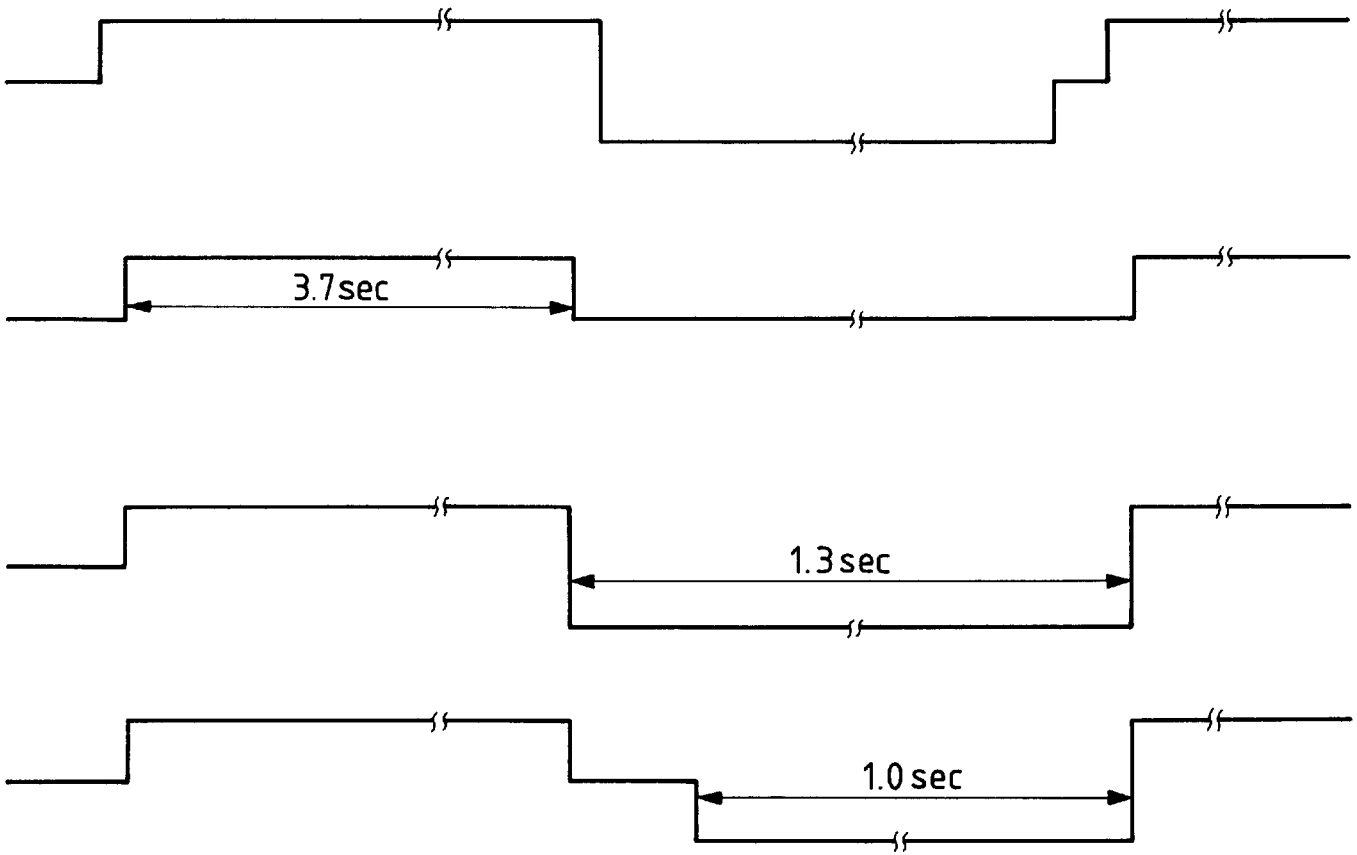
FIGS. 7A to 7D are timing charts showing a sequence in the continuous magnify-record mode or density fluctuation prevent mode in the invention.

On the other hand, when the continuous magnify-record mode is selected by the mode select switch 27, a timing chart as shown in FIGS. 7A to 7D is derived. The carriage motor control signal 32 in FIG. 7A and the image control signal 31 in FIG. 7B are the same as those in the normal copy mode. Although the drive control signal 34 in FIG. 7C is substantially the same as that in the normal copy mode when the image is formed, its polarity is inverted when the image formation of one scan is finished. In case of the negative drive control signal 34, namely, at the time of the carriage return, a driving pulse of a short width is generated as shown in FIG. 6B. Conditions for such a short driving pulse are set in a range such that it is insufficient to eject the ink. In case of the embodiment, the pulse width is set to 4 μsec.

Figure 8:
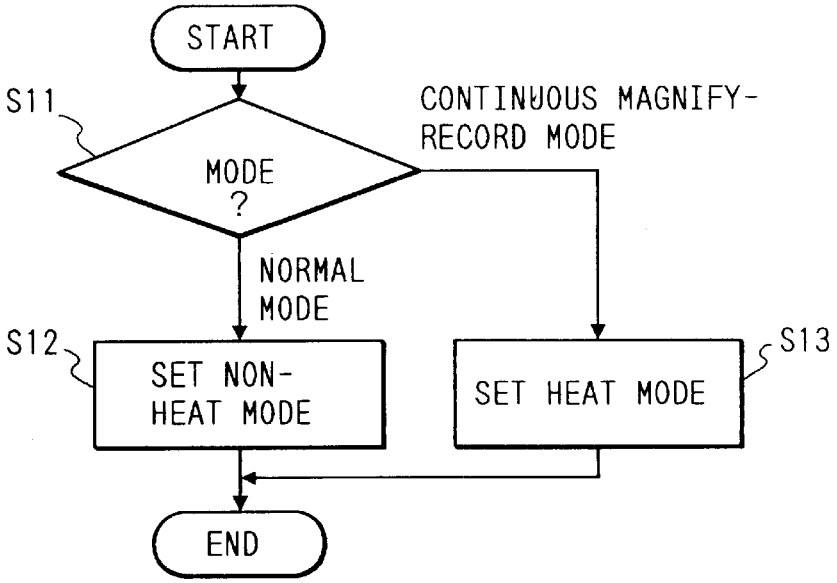
FIG. 8 is a flowchart showing the operation in an embodiment 4.

The above operation will now be described with reference to a flowchart of FIG. 8. In step S11, the CPU 29 sends the drive control signal 34 according to the set signal (copy mode) 28 from the select switch 27 to the driver circuits 24*a* to 24*d*. In steps S12 and S13, the driver circuits 24*a* to 24*d* set the conditions of the driving pulses at the end of the image formation, namely, at the time of the carriage return in accordance with the drive control signal 34. That is, in the normal copy mode, a non-heat mode (step S12) is set. In the continuous magnify-record mode, a heat mode in which the driving pulse (step S13) of FIG. 6B is output is set.

In case of forming an image by the A1 size, the image width is set to 594 mm as mentioned above. In the embodiment, in order to perform the recording at 2.5 kHz and 400 dpi, a length of image control signal 31 is set to $$(594*400)/(25.4*2500)=3.74 \text{ sec}$$

The time of the carriage return (back scan) is faster than the above time and is equal to about 1.3 sec. In the case where the non-ejection pulse for heating is set to 4 μsec, the non-ejection pulse is continuously applied for a period of time of 1.3 sec during the back scan as shown in FIG. 7C. When the applying time is shorter than 1.3 sec, the effect is insufficient.

When a pulse of a width 5 μsec is used as a non-ejection pulse, as shown in FIG. 7D, an enough effect is derived by applying the non-ejection pulse from a time point of 1.0 sec before the start of the next printing. On the contrary, when the non-ejection pulse is applied for a time longer than 1.0 sec, there is a case where the density of a boundary portion of the scan becomes too dense. It is sufficient to experimentally obtain the relation between the pulse width of the non-ejection pulse and the optimum applying time in a manner such that, while the actual image is copied, density differences of the starting edge portion of the continuous magnify-record are measured and the relation such as to minimize the density difference is obtained.

Figure 9:
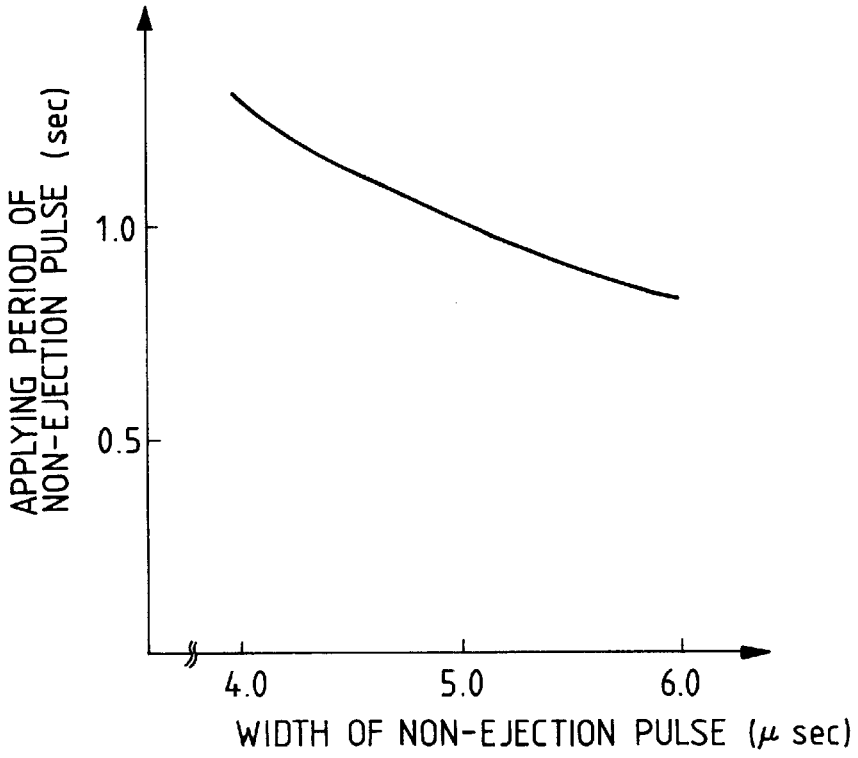
FIG. 9 is a graph showing the relation between the pulse width of a non-ejection pulse and its optimum applying time in the invention.

FIG. 9 is a graph showing an example of the relation obtained as mentioned above. Since it differs depending on the head structure or the like, it is desirable to obtain the proper relation each time the apparatus is designed.

Figure 3:
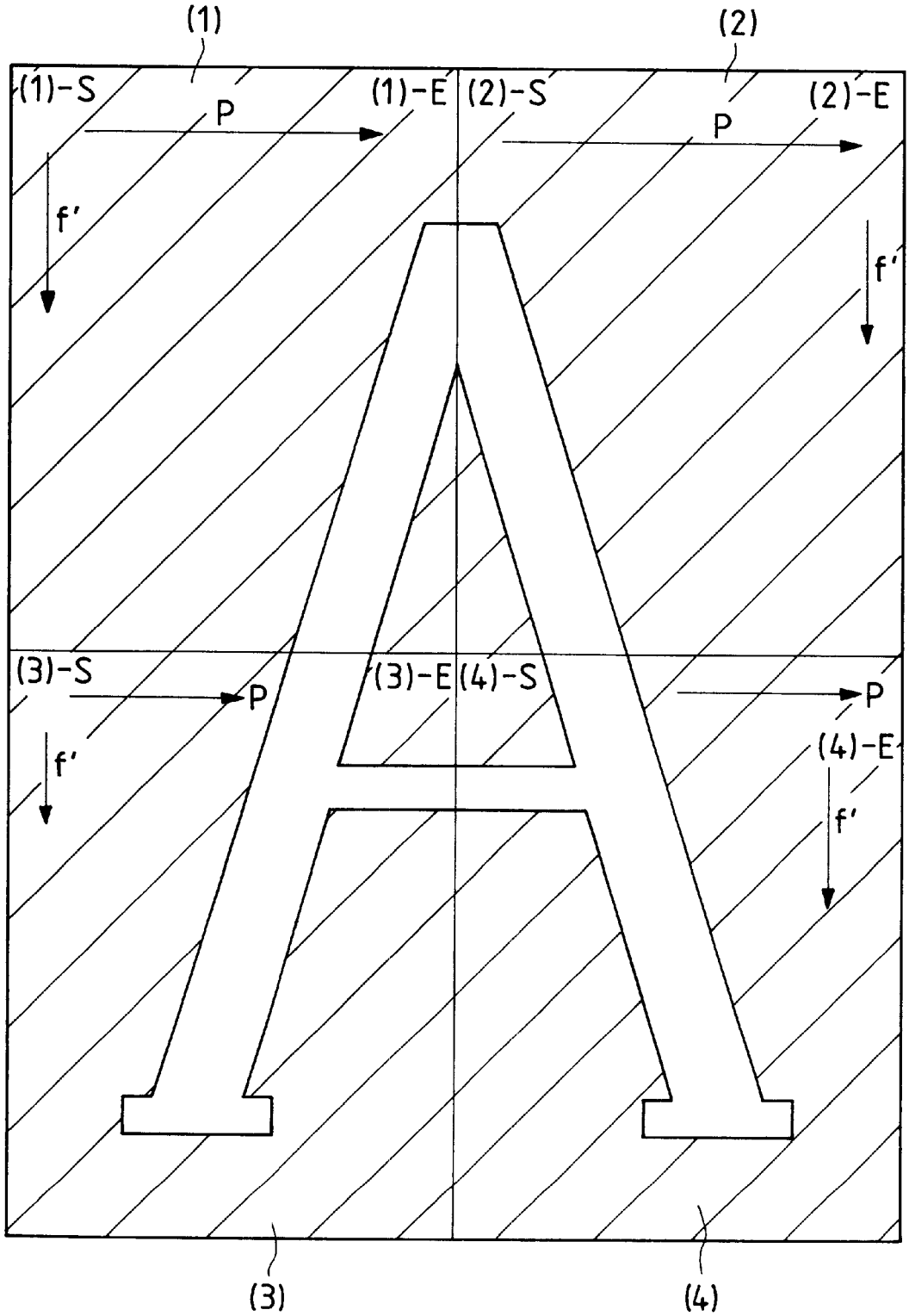
FIG. 3 is an explanatory diagram of a copy in a continuous magnify-record mode.

After completion of the image formation of one scan, the pulse of a duration such as not to eject the ink is applied to the electrothermal transducer of the head as mentioned above, so that the head temperature doesn't decrease. Therefore, the image density at the starting edge of the next scan doesn't decrease. Even in the case where the copies are combined as shown in FIG. 3, the density difference can be suppressed to a level such that the joint portions are inconspicuous.

Embodiment 2

An embodiment 2 will now be described. In the embodiment 1, the select switch is used to select the continuous magnify-record mode and, when such a mode is selected, the image data is controlled so as to correspond to the continuous magnify-record. For example, in case of inputting image data from the original image reader, the reading position on the original and the magnification are controlled. In case of inputting the image data from the computer, the location of the image data and the magnification are controlled.

However, there is also a case where it is highly necessary to suppress the density fluctuation in a mode other than the continuous magnify-record mode. On the contrary, even in the continuous magnify-record mode, there is also a case where the density difference causes no problem in dependence on the original image.

In consideration of such a point, the embodiment 2 independently has the continuous magnify-record mode and the density fluctuation prevent mode.

Figure 10:
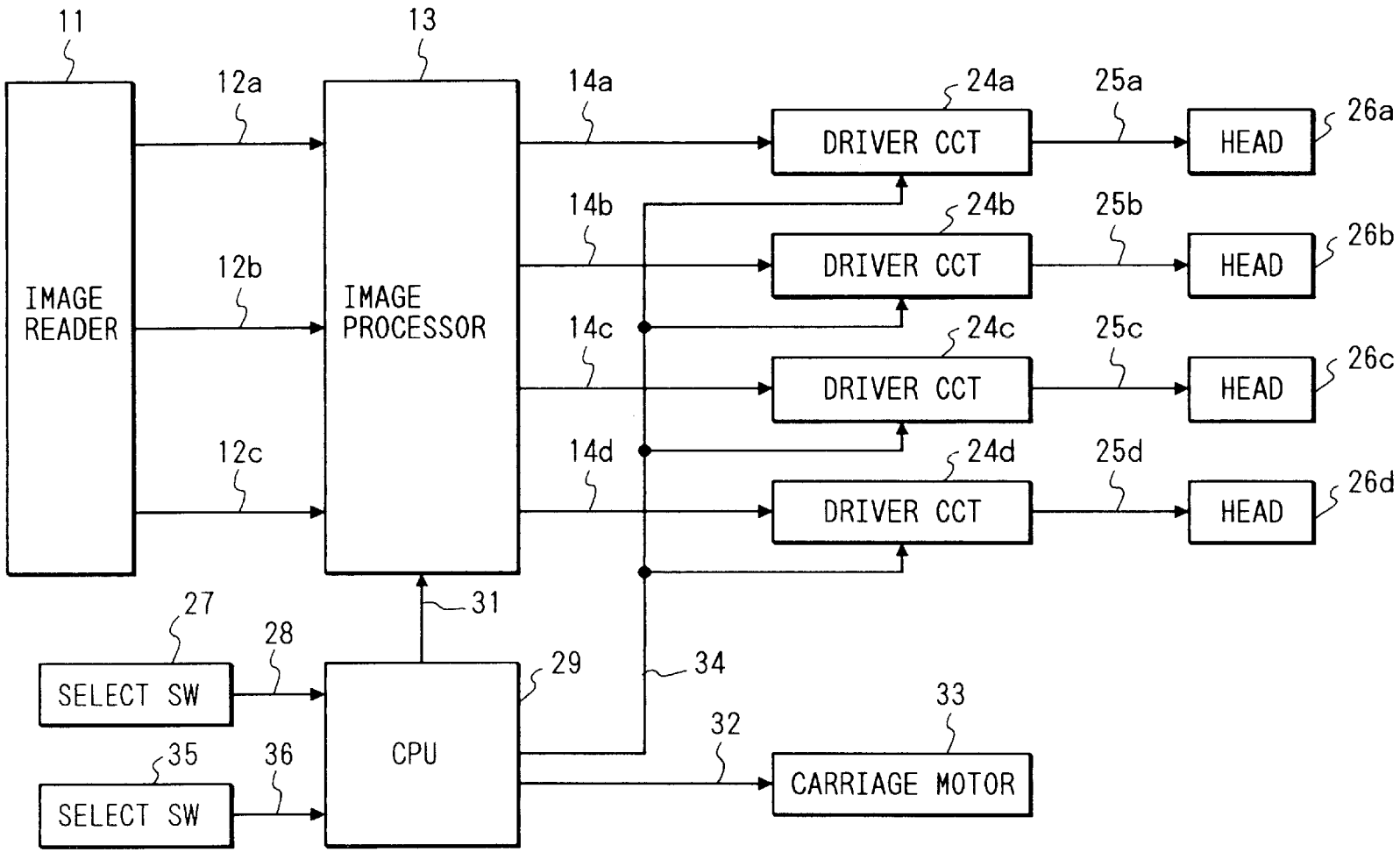
FIG. 10 is a block diagram of an embodiment 2.

FIG. 10 is a block diagram of the embodiment 2, in which the same component elements as those shown in FIG. 1 are designated by the same reference numerals. In the diagram, reference numeral 35 denotes a select switch of the density fluctuation prevent mode and 36 indicates the selecting signal (b). The copy mode select switch 27 is used to merely select whether the copying operation is performed in which one of the continuous magnify-record mode and the normal copy mode. That is, whether the heat pulse of a duration such as not to eject the ink is given for a period of time during which no ink is ejected is not selected by the switch 27.

The heat pulse is selected by the density fluctuation prevent mode select switch 35 and is given only when the switch 35 is ON. Therefore, the density difference can be reduced as necessary even in a mode other than the continuous magnify-record mode. In addition, when an original which hardly causes a density difference even in the continuous magnify-record mode is used, there is no need to perform the unnecessary head heating operation. Thus, the life of the head is not unnecessarily reduced.

Embodiment 3

An embodiment 3 will now be described. In the above embodiment, a pulse of a short width has been used as a heat pulse which doesn't eject the ink. However, according to such a pulse waveform, there is a case where the range of the pulse width such as not to eject the ink is narrow and the head cannot be sufficiently heated. For example, assuming that a standard pulse for ejecting the ink is equal to 10 $\mu$sec, when the heat pulse is set to about 5 $\mu$sec, a boiling of the ink occurs and the ink is ejected, so that there is a case where the recording paper becomes dirty. Therefore, the pulse conditions such that the head can be heated are limited.

Figure 6C:
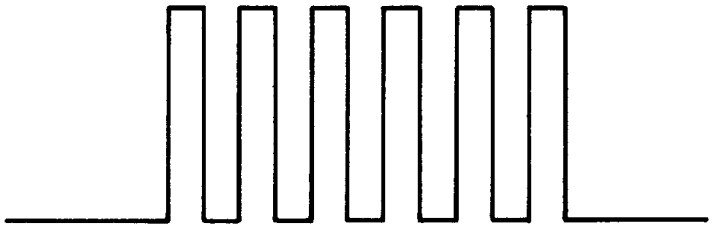

The embodiment intends to cope with such a problem and devises a heat pulse waveform which doesn't eject the ink. The inventors of the present invention examined various pulse waveforms, so that they have found out that by dividing the waveform as shown in FIG. 6C, a larger energy can be applied without ejecting the ink. In the embodiment, a waveform such that the ON state of 1 $\mu$sec and the OFF state of 1 $\mu$sec are repeated is used. By using such a waveform, even when a pulse of total 6 $\mu$sec is given, no ink is ejected and the head can be more efficiently heated.

In the above embodiment, the head heat pulse of a short width has been used. However, the invention is not limited to such a pulse but the invention can be also similarly embodied even by using a pulse of a low voltage. Although the embodiment has been described above with respect to an example in which the head heat pulse is applied in the continuous magnify-record mode, the invention is not necessarily limited to the continuous magnify-record mode but can be also embodied in another copy mode in which the density change is conspicuous.

Embodiment 4

An embodiment 4 will now be described. In the ink jet recording apparatus, generally, an ink blur on the recording material exerts a large influence on the picture quality.

Figure 12A:
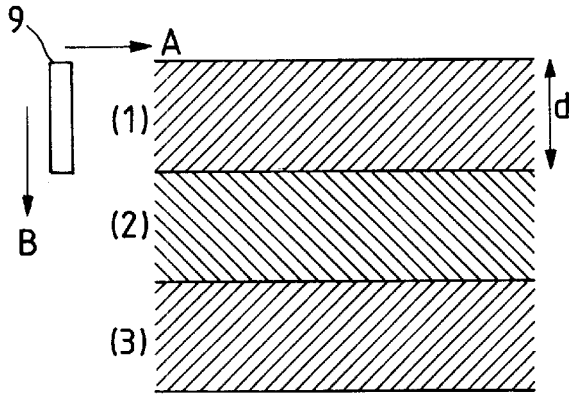
FIG. 12A PRIOR ART
FIGS. 12A and 12B are explanatory diagrams of a boundary blur.
Figure 12B:
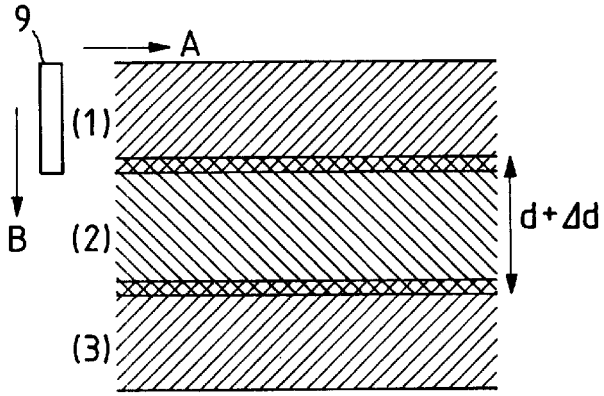
FIG. 12B PRIOR ART

In the ink jet recording apparatus of the serial scan type as shown in FIG. 2, as shown in FIGS. 12A and 12B, the recording head 9 is scanned (main scan) in the A direction and the image recording of only a width (d) is sequentially repeated in accordance with the order of (1), (2), and (3) in the diagram. The width (d) is decided by the number of nozzles of the head and the recording density and is set to 16.256 mm in case of 256 nozzles and 400 dots/inch.

When an amount of ink to be recorded is small, a blur is small and the width of the recorded image is almost equal to the recording width (d). Therefore, after the head was scanned (subscan) in the B direction by only a distance of (d), if the image is recorded in the A direction, the boundary portion of each recording scan doesn't cause any problem on the image as shown in FIG. 12A.

However, in a high density portion, namely, an image of a large ink amount, the ink is blurred and the width of the recorded image is equal to d+Δd. Assuming that the scan width in the B direction is equal to (d) in this instance, the image is overlapped by only Δd and a banding occurs as shown in FIG. 12B. On the contrary, when the scan width is previously set to d±Δd, a white line occurs in a low density portion of a small ejection ink amount.

With respect to such a problem, the inventors of the present invention have proposed image recording apparatuses such that, when the image signal existing in the boundary portion of the serial scan is large, its image signal value is corrected to a small value, thereby preventing the banding in the high density portion in the specification of U.S. Pat. No. 5,225,849 (JP-A-2-3326, JP-A-2-25338), JP-A-2-219659, JP-A-2-265749, and the like.

Those principles will now be described. First, by detecting the signal in the scan boundary portion, an amount of ink to be printed in the boundary portion is judged. When an amount of ink to be printed in the boundary portion is small, no banding is formed due to the blur. Therefore, no process is particularly performed to the signal in the boundary portion. When the ink amount of the boundary portion is large, by reducing the signal that is printed in the boundary portion, the blur is-suppressed, thereby preventing the banding. A degree of reduction of the signal in the boundary portion is determined in accordance with the amount of ink to be printed in the boundary portion.

There are, however, the following problems in case of using both of the correction of the blur in the boundary portion mentioned above and the applying of the non-ejection pulse according to the mode described in each of the above embodiments.

The ink temperature in case of recording in the normal mode obviously differs from the ink temperature in the case where the recording is performed while heating the head by applying the non-ejection pulse. A change in ink temperature causes a change in ink viscosity, so that the ejection amount changes. When the ejection amount changes, the blur on the recording material changes and the banding in the boundary portion also changes.

Therefore, there is a problem such that, when the image is recorded in the non-ejection pulse applying mode by the blur correction amount in the normal mode, the blur is still too large and the effect to reduce the banding is insufficient.

The embodiment is made to solve the above problem and by controlling the correction amount of the image signal to be recorded by the nozzles in the boundary portion in each scan in accordance with the applying conditions of the non-ejection pulse, even in case of applying the non-ejection pulse to the head, the image of a small banding in the boundary portion in the scan can be obtained.

Figure 11:
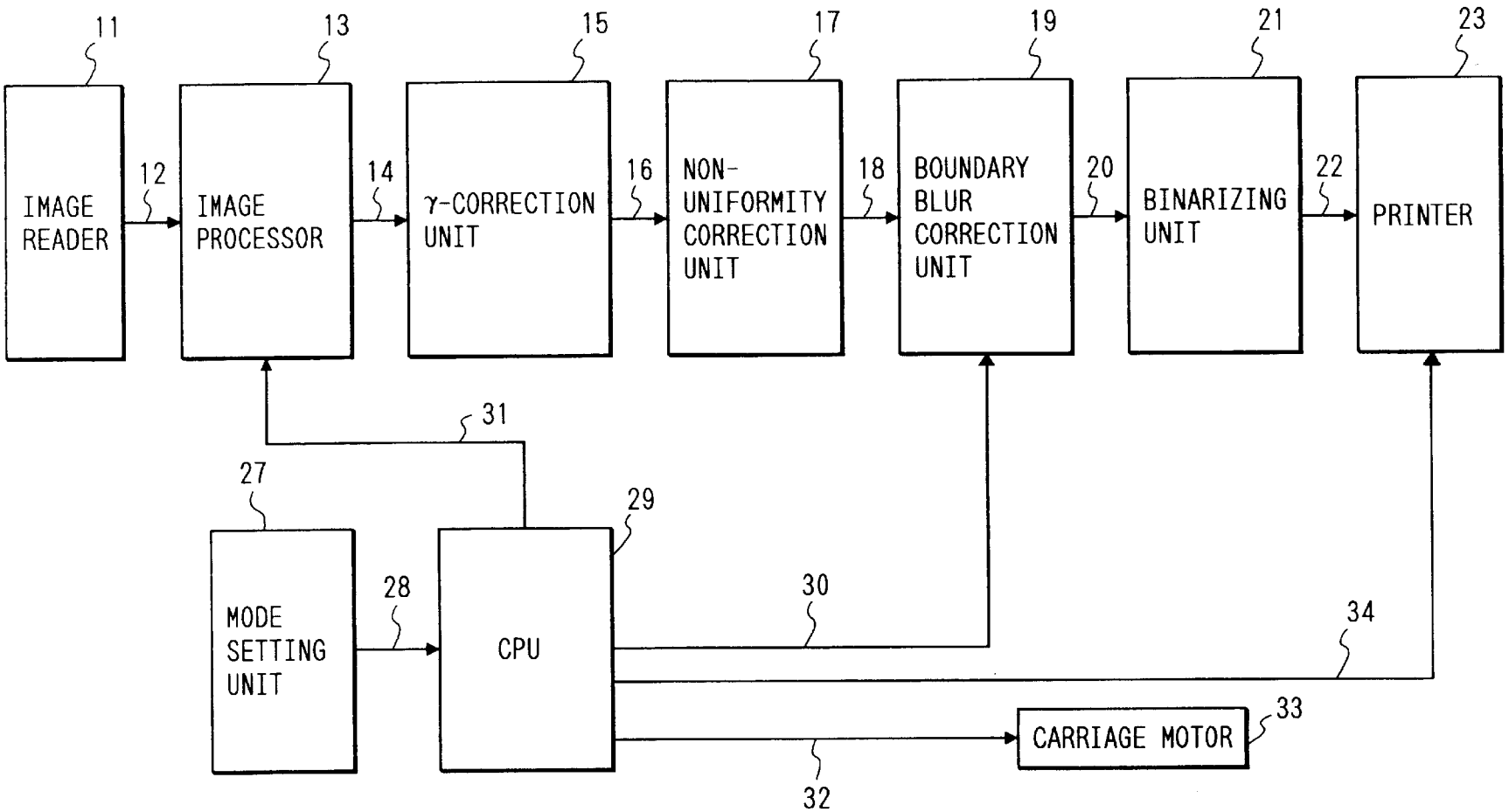
FIG. 11 is a block diagram of an embodiment 4.

FIG. 11 is a block diagram showing an embodiment 4 and the portions having the functions corresponding to those in FIG. 1 are designated by the same reference numerals. In the diagram, reference numeral 11 denotes the original image reader for reading the original image; 12 read signals of red (R), green (G), and blue (B); 13 an image processor for performing image processes such as logarithm conversion, black extraction, UCR, masking, and the like; 14 color signals of cyan (C), magenta (M), yellow (Y), and black (Bk) which are obtained after completion of the image processes; 15 a gamma (γ) correction unit to perform a gradation correction; 16 color signals obtained after completion of the gradation correction; 17 a head non-uniformity correction unit to correct a density non-uniformity of the printing head; 18 image signals after completion of the non-uniformity; 19 a boundary blur correction unit; 20 image signals after completion of the boundary blur correction; 21 a binarizing unit; 22 image signals after completion of the binarization; 23 the printer; 27 the mode setting unit; 28 the mode setting signal; 29 the CPU; 30 a boundary blur correction control signal; 31 the image control signal; 32 the carriage motor control signal; 33 the carriage motor; and 34 the drive control signal.

In the construction of FIG. 11, the image reader 11 reads the original image and sends three color signals of R, G, and B to the image processor 13. The image processor 13 executes the foregoing image processes to the color signals and generates the image signals 16 of C, M, Y, and Bk. The head non-uniformity correction unit 17 performs a correction such as to set off the non-uniformity characteristics of the head to the image signals 16. For example, in case of the image signal to be printed by the nozzle of a large ink ejection amount, its value is reduced. In case of the signal to be printed by the nozzle of a small ink ejection amount, its value is increased. Reference numeral 18 denotes the signals after completion of the non-uniformity correction. The boundary blur correction unit 19 executes a blur correcting process to the signals 18 as will be explained in detail hereinlater.

Reference numeral 20 denotes the signals after completion of the blur correction. The signals 20 are sent to the binarizing unit 21 and are binarized by a method such as dither method, error diffusion method, or the like. Reference numeral 22 denotes the image signals after completion of the binarization. The signals 22 are sent to the printer 23, by which an image is recorded.

The blur correcting process which is executed by the boundary blur correction unit 19 will now be described.

First, the image signal which is printed by the boundary portion by the scan is obtained by a calculation. That is, now assuming that the color signals to be printed by the nozzles in the boundary portion are set to Ce, Me, Ye, Bke, $$T=a\cdot Ce+b\cdot Me+c\cdot Ye+d\cdot Bke$$

is obtained. In the case where the number of nozzles which are used per one scan is equal to 256, the first nozzle and the 256th nozzle are used as nozzles in the boundary portion. In the case where the number of nozzles which are used is equal to 128, the first nozzle and the 128th nozzle are used in the odd-number designated scan, while the 129th nozzle and the 256th nozzle are used in the even-number designated scan. In the case where the number of nozzles which are used, the first nozzle and the 64th nozzle are used in the first scan, the 65th nozzle and the 128th nozzle are used in the second scan, the 129th nozzle and the 192nd nozzle are used in the third scan, and the 193rd nozzle and the 256th nozzle are used in the fourth scan. The nozzles which are used for calculations are not always limited to only those nozzles but a range which exerts an influence on the banding in the boundary portion can be also experimentally obtained. In case of the embodiment, the image signals in a range of every two nozzles in each of the upper and lower portions from the boundary portion are used for the calculations. Reference characters (a, b, c, d) denote weight coefficients and are also experimentally obtained.

Practical numerical values in the normal recording in the embodiment are as follows.

Each of Ce, Me, Ye, and Bke has a value within a range from 0 to 255.

$$a=b=c=d=1.0$$

Therefore, T has a value in a range from 0 to 1020.

Figure 13:
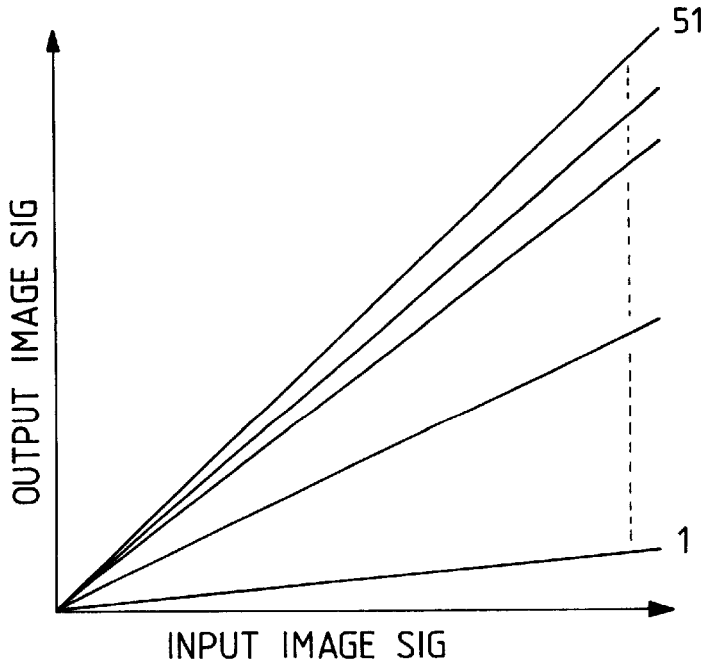
FIG. 13 is a graph showing a correction table of a boundary image signal.

The image signal which is printed by the nozzle in the boundary portion is corrected by a table as shown in FIG. 13. FIG. 13 shows the table in which 51 straight lines having inclinations of 1.0 to 0 are stored at regular intervals. Which one of the lines is selected is determined in accordance with the value of T. For example, when the value of T is equal to or less than T0, no correction is performed and the signal is directly output on the basis of the straight line of the inclination 1.0. When the value of T exceeds T0, however, the inclination is decreased in accordance with the value of T. Namely, a correction amount is increased so as to further reduce the density of the image signal. The correspondence relation between the value of T and the straight lines are previously set in an ROM.

A specific example in the embodiment will now be explained hereinbelow.

Figure 14:
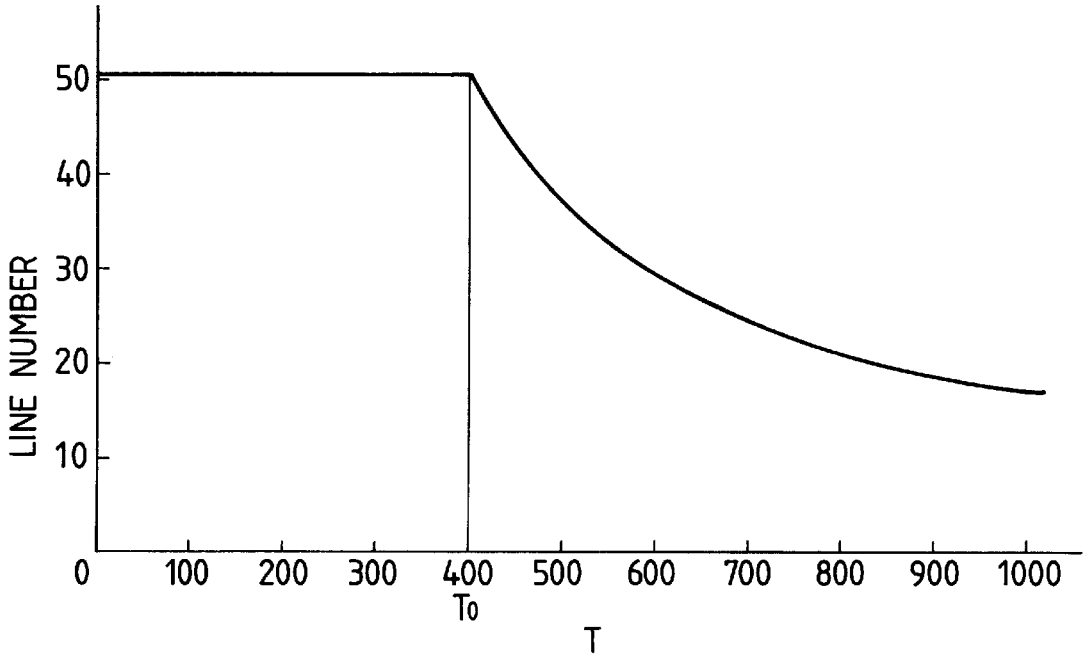
FIG. 14 is a graph showing a table indicating a correspondence relation between T in the embodiment 4 and the correction table.

In FIG. 13, the straight lines are numbered in a manner such that the straight line of the inclination 0 is set to No. 1, the straight line of the inclination 0.2 is set to No. 2, the straight line of the inclination 0.4 is set to No. 3, . . . , and the straight line of the inclination 1.0 is set to No. 51. The correspondence relation between the value of T and the numbers of the straight lines is set as shown in FIG. 14. That is, T0=400 and when the value of T is equal to or less than 400, no correction is performed. When the value of T exceeds 400, the inclination of the straight line that is selected is reduced and the correction amount (decrease amount) is increased. Such a relation is set into an ROM or RAM in which the value of T is set to the address input and the straight line No. is set to the output data. The table of FIG. 13 is set into another ROM or RAM in which the inclination can be selected by an output of the ROM or RAM. The image signal corresponding to the boundary nozzle is input into such an ROM or RAM, thereby performing the correction.

With respect to a point that the signal correction is performed by using which nozzle as a boundary portion, the same nozzle as that used when obtaining T can be used. However, it is not always necessary to use the same nozzle. For example, when the magnification is equal to 100%, four nozzles of the first, second, 255th, and 256th nozzles are used to obtain T and two nozzles of the first and 256th nozzles can be also used to perform the correction.

A characteristic portion of the embodiment will now be described. The mode setting unit 27 is an operating unit for setting the normal copy mode and continuous magnify-record mode and, further, for setting the copy magnification, recording paper size, original size, and the like. The user sets the recording conditions. The setting signal 28 is sent to the CPU 29 and the blur correction control signal 30 according to the mode is sent to the blur correction unit 19. The blur correction unit 19 resets the weight coefficients in accordance with the blur correction control signal 30. As described in the above embodiment, the drive control signal 34 is sent to the driver circuits (24*a* to 24*d* in FIG. 1) of the printer 23. The driver circuits 24*a* to 24*d* set the heat mode in accordance with the drive control signal 34.

In the embodiment, the weight coefficients are changed in accordance with the heat mode. In case of selecting the continuous magnify-record mode, the weight coefficients which are used in the correction calculation are changed simultaneously with the setting of the heat mode. Now, assuming that coefficients for the normal mode are set to a1, b1, c1, and d1 and coefficients for the continuous magnify-record mode are set to a2, b2, c2, and d2, in the embodiment, $$a1=b1=c1=d1=1.0$$

$$a2=b2=c2=d2=0.8$$

are set.

That is, $$a2,\ b2,\ c2,\ d2>a1,\ b1,\ c1,\ d1$$

is set. The value of T in the continuous magnify-record mode is set to be larger than that in the normal mode and the correction amount is also set to a large value.

By constructing as mentioned above, by raising the ink temperature by applying the non-ejection heat pulse, the density difference when the continuous enlarged images are combined can be reduced. By also increasing the value of T, the correction amount to the image signal in the boundary portion is increased, thereby enabling the banding in the scan boundary portion to be also reduced.

Figure 15:
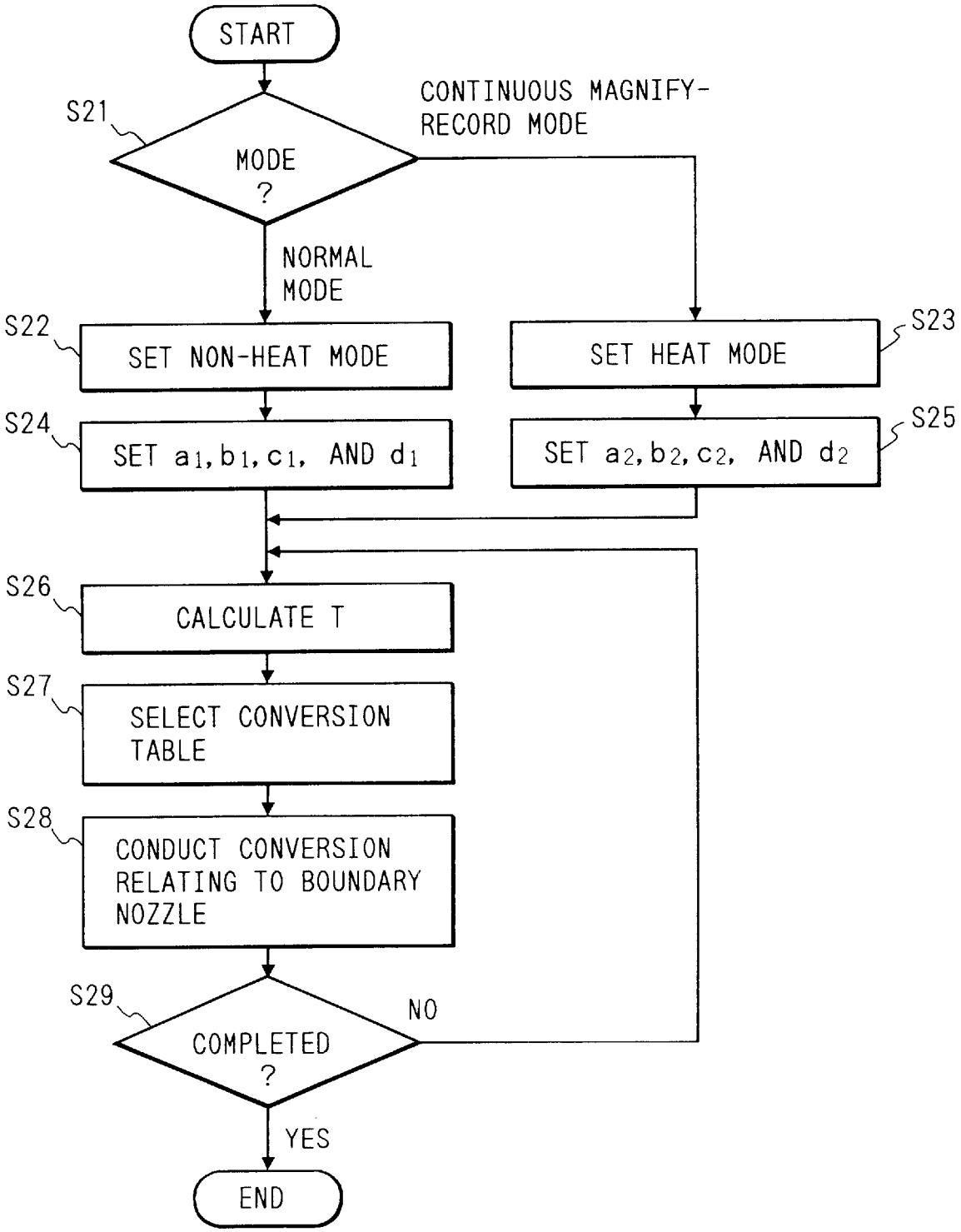
FIG. 15 is a flowchart showing the operation in the embodiment 4.
Figure 17A:
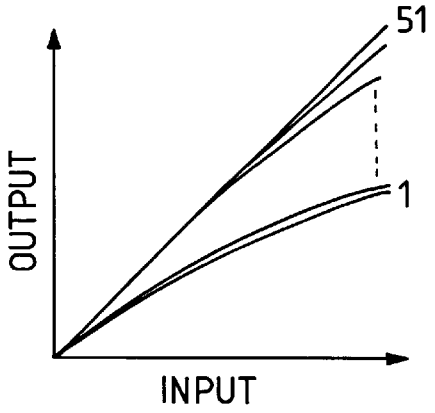
FIGS. 17A to 17D are diagrams showing other correction tables of a boundary image signal.
Figure 17B:
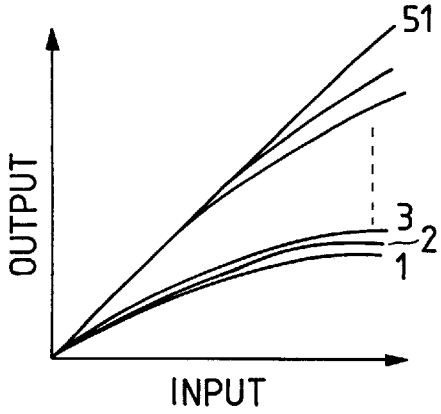
Figure 17C:
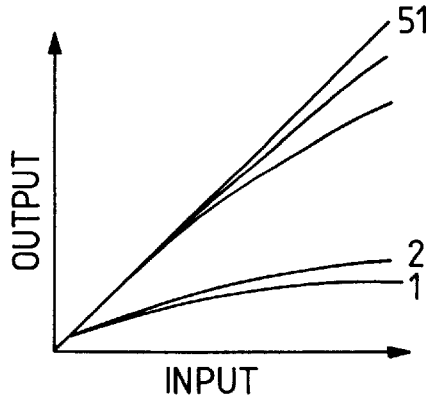
Figure 17D:
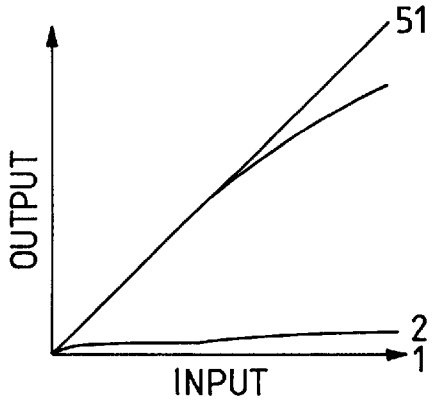

The above operation will now be described with reference to a flowchart of FIG. 15. In step S21, the CPU 29 sends the drive control signal 34 according to the setting signal (copy mode) 28 from the select switch 27 to the driver circuits 24*a* to 24*d* of the printer 23. In steps S22 and S23, the driver circuits 24*a* to 24*d* set the conditions of the driving pulse at the end of the image formation, namely, at the time of the carriage return in accordance with the drive control signal 34. Namely, in the normal copy mode, the non-heat mode (step S22) is set. In the continuous magnify-record mode, the heat mode in which the driving pulse (step S23) in FIG. 6B is set.

Further, the CPU 29 sends the blur correction control signal 30 according to the setting signal (copy mode) 28 from the mode setting unit 27 to the boundary blur correction unit 19. In steps S24 to S25, the boundary blur correction unit 19 sets the weight coefficients a1, b1, c1, d1, a2, b2, c2, and d2 in accordance with the blur correction control signal 30. In step S26, the value of T is calculated on the basis of the set weight coefficients and the color signals of the boundary portion. In step S27, the conversion table (straight line number) of FIG. 13 corresponding to the value of T is selected in accordance with FIG. 14. In step S28, the conversion according to the conversion table in FIG. 13 selected in step S27 for the color signals to the boundary nozzle is executed. In step S29, the above processes are repeated until the recording of one page is finished.

In the embodiment, it is sufficient to experimentally obtain the specific values of the weight coefficients in each case and various values can be set. For example, in case of the embodiment, by using a principle that the amount of the Bk ink is dominant as compared with the other inks in the high density portion, only the value (of) d is controlled and $$a1=b1=c1=d1=1.0$$

$$a2=b2=c2=1.0,\ d2=0.6$$

are set, so that an enough effect can be also obtained. Due to this, there are also effects such that the control is simplified and the troublesomeness in case of experimentally obtaining the weight coefficients can be reduced.

By controlling the blur correction amount in accordance with the copy mode, even when the ink temperature changes, an image of a small banding in the scan boundary portion can be obtained.

Embodiment 5

An embodiment 5 will now be described.

The embodiment relates to the case where the non-ejection pulse is not applied at the time of the non-printing mode but is applied during the image formation. In case of copying an image of the A4 size at a magnification of 100%, the image is recorded by using all of the 256 nozzles in the normal scan. However, since the length (297 mm) of the A4 size is not an integer times as large as the width (16.256 mm) of one scan, it is necessary to adjust the length for one scan. The printing width of the scan to adjust the length is equal to $$297-16.256*18=4.392\ \text{mm}$$

and the number of nozzles which are used in this scan is equal to 69. In such a case, since the head temperature is lower than that in case of the other scan, the image density decreases and becomes uneven.

To cope with such a problem, there is known a method whereby, when printing of the length adjustment scan, the non-ejection pulse is applied to the nozzles which are not used, thereby preventing a decrease in head temperature. Even in such a case, the head temperature doesn't always coincide with the temperature in the normal print mode and there is a case where a state the banding differs from the banding in the boundary portion in the other scan.

The embodiment intends to control the blur correction amount in such a scan. A block construction of the embodiment is substantially similar to that in FIG. 11 except that the weight coefficients are changed at the time of the scan for performing the length adjustment. The CPU 29 calculates the number of nozzles which are used in the length adjustment scan from the magnification, size of recording paper, and size of original which were set by the mode setting unit 27. In accordance with the result of the calculation, the CPU 29 applies the non-ejection pulse to the nozzles which are not used and also controls the weight coefficients at the time of the length adjustment scan. The relation between the number of nozzles to be used and the weight coefficients is previously obtained by experiments. Even in case of applying the non-ejection pulse during one image formation as mentioned above, the banding in the boundary portion can be reduced.

Embodiment 6

An embodiment 6 intends to perform a blur correction in the embodiment 3 in which the waveform of the non-ejection pulse is changed. In the embodiment 3, as shown in FIG. 6C, by using the waveform such that the ON state of 1 μsec and the OFF state of 1 μsec are repeated, even by applying the pulse of total 6 μsec, no ink is ejected and the head can be more efficiently heated.

Since the optimum blur correction amount can be known due to it, the optimum calculation coefficients are obtained and the weight coefficients are changed to those optimum coefficients in the mode for applying the non-ejection pulse mentioned above, an image of a small boundary banding is obtained in a manner similar to each of the above embodiments.

Embodiment 7

An embodiment 7 will now be described.

In the embodiments 4 to 6, the weight coefficients have been controlled as means for controlling the blur correction amount. In the embodiment, the correction amount is controlled by changing the correspondence relation between the correction table and the value of T. The embodiment 7 has a block construction that is substantially similar to that in FIG. 11 except that the blur correction unit 19 prepares a plurality of correspondence relations between the calculation result T and the correction table and controls the correspondence relation in accordance with the blur correction signal 30, thereby controlling the blur correction.

Figure 16:
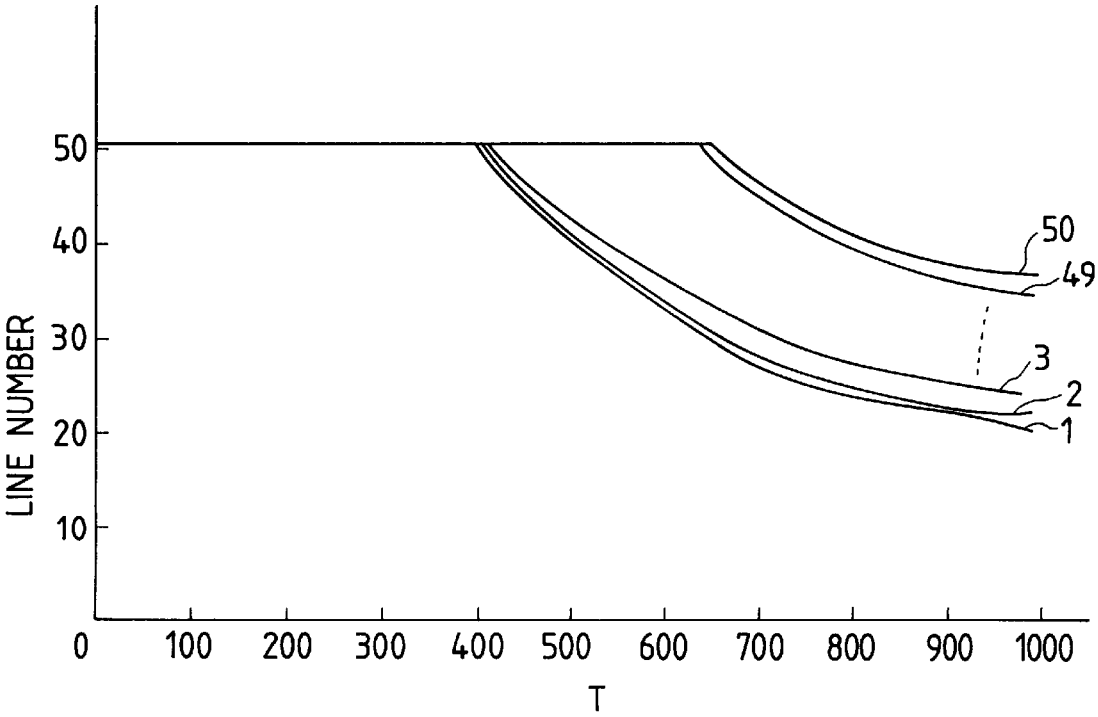
FIG. 16 is a diagram showing a table indicating the correspondence relation between T in an embodiment 7 and the correction table.

FIG. 16 shows the correspondence relations between T and the correction table in this case. One of the correspondence relations 1 to 50 is selected in accordance with the heat mode (copy mode). In the case where the ejection amount is large and the boundary blur is remarkable, the relation such as to decrease T0 and to enlarge the correction is selected. In case of the diagram, since T0 of the correspondence relation 1 is smaller than that of the correspondence relation 50, the correction amount to reduce the ejection amount is large.

Not only the correspondence relation between T and the correction table but also a shape of a correction table curve in FIG. 13 can be also changed.

FIGS. 17A to 17D show correction curves in this case. In the case where the curve of the same number is selected, a plurality of curves from (A) of a small correction ratio to (D) of a large correction ratio are prepared. When the ejection amount is large, the curve (D) is selected. As the ejection amount decreases, the table of a small correction ratio is selected like (C)→(B)→(A). At the same time, the correction curve is set to be non-linear, thereby correcting in a manner such that when the input signal is large, the output is set to be smaller.

Since the shape of the table can be set to a free curve, there is an advantage such that a degree of freedom of the correction further increases.

The algorithm of the blur correction, structure of the ink jet recording apparatus, structure of the head, waveform of the non-ejection pulse, and the like are not limited to those shown in the above embodiments 4 to 7.

For example, it is also possible to use a construction such that the piezoelectric type ink jet head is used and the ink ejection amount is directly modulated in an analog manner. The invention can be also similarly embodied even when a pulse of a dropped voltage is used as a non-ejection pulse.

The present invention is particularly suitable for use in an ink jet recording head and a recording apparatus wherein a thermal energy generated by an electrothermal transducer, a laser beam, or the like is used to cause a change of state of the ink to eject or discharge the ink. This is because the high density of the picture elements and the high resolution of the recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development, and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing pressure waves of the thermal energy is formed corresponding to the ejecting portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. Examples of such means include capping means for the recording head, cleaning means therefore, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to the plurality of ink materials having different recording colors or densities. The present invention is effectively applied to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below the room temperature but liquid at room temperature. Since the ink is kept within a temperature between 30° C. and 70° C., in order to stabilize the viscosity of the ink to provide the stabilized ejection in the usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 54-56847 and Japanese Laid-Open Patent Application No. 60-71260. The sheet is faced to the electrothermal transducers. The most effective one of the techniques described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as many come within the purposes of the improvements or the scope of the following claims.

According to the invention as described above, only in case of selecting a predetermined mode such as a continuous magnify-record mode in which a uniformity of the image density is strongly required, the non-ejection pulse under conditions such as not to eject the ink is applied to the head in the non-print mode, so that the non-uniformity of the image density can be suppressed and the decrease in life of the head can be minimized.

Further, by controlling the blur correction amount in the boundary portion in accordance with the conditions of the non-ejection pulse, even when the image recording conditions are changed, a good image of a small banding of the boundary portion can be always obtained.

What is claimed is:

1. An ink jet recording apparatus for recording an image by using a recording head to emit an ink by a heat generation of an electrothermal transducer, said apparatus performing recording onto a recording medium by relatively scanning said recording head and the recording medium, said apparatus comprising:

driving means for driving said recording head in a recording mode selected from a plurality of recording modes, said recording modes including a first recording mode, for performing normal recording on a sheet of the recording medium and a second recording mode, for recording different portions of a single image onto a plurality of sheets, respectively, of the recording medium;

supplying means for supplying a non-ejection heating signal to said electrothermal transducer so as not to eject the ink;

selecting means for selecting conditions for supplying said non-ejection heating signal by said supplying means depending upon the recording mode; and control means for controlling said supplying means in accordance with the conditions selected by said selecting means depending upon the recording mode so that said supplying means is driven to reduce a difference between a head temperature at a start of a scan and the head temperature at an end of the scan when the second recording mode is selected.

2. An apparatus according to claim 1, wherein said second recording mode is a mode for combining a plurality of output images to form a final output image, and said selecting means selects said conditions in accordance with whether said second recording mode is executed.

3. An apparatus according to claim 1, wherein said control means allows said supplying means to supply said non-ejection heating signal when the image recording is not executed.

4. An apparatus according to claim 1, wherein said supplying means further comprises means for supplying an ejection signal to said electrothermal transducer so as to eject the ink, and a signal width of said non-ejection heating signal is shorter and a frequency thereof is higher than a width and a frequency of the ejection signal.

5. An apparatus according to claim 1, further comprising scanning means for scanning said recording head.

6. An apparatus according to claim 5, wherein said control means allows said supplying means to supply said non-ejection heating signal for a period of time during which said recording head is returned by said scanning means.

7. An apparatus according to claim 1, wherein said recording head ejects inks of a plurality of colors.

8. An apparatus according to claim 1, further comprising conveying means for conveying a recording medium that is recorded by said recording head.

9. A copying machine, comprising:

copying means for copying; and an ink jet recording apparatus for recording an image by using a recording head to emit an ink by a heat generation of an electrothermal transducer, said apparatus performing recording onto a recording medium by relatively scanning said recording head and the recording medium, said apparatus comprising driving means for driving said recording head in a recording mode selected from a plurality of recording modes, said recording modes including a first recording mode, for performing normal recording on a sheet of the recording medium and a second recording mode, for recording different portions of a single image onto a plurality of sheets, respectively, of the recording medium, supplying means for supplying a non-ejection heating signal to said electrothermal transducer so as not to eject the ink, selecting means for selecting conditions for supplying said non-ejection heating signal by said supplying means depending upon the recording mode, and control means for controlling said supplying means in accordance with the conditions selected by said selecting means depending upon the recording mode so that said supplying means is driven to reduce a difference between a head temperature at a start of a scan and the head temperature at an end of the scan when the second recording mode is selected.

10. A facsimile apparatus, comprising:

facsimile means for performing facsimile operations; and an ink jet recording apparatus for recording an image by using a recording head to emit an ink by a heat generation of an electrothermal transducer, said ink jet recording apparatus performing recording onto a recording medium by relatively scanning said recording head and the recording medium, said ink jet recording apparatus comprising driving means for driving said recording head in a recording mode selected from a plurality of recording modes, said recording modes including a first recording mode, for performing normal recording on a sheet of the recording medium and a second recording mode, for recording different portions of a single image onto a plurality of sheets, respectively, of the recording medium, supplying means for supplying a non-ejection heating signal to said electrothermal transducer so as not to eject the ink, selecting means for selecting conditions for supplying said non-ejection heating signal by said supplying means depending upon the recording mode, and control means for controlling said supplying means in accordance with the conditions selected by said selecting means depending upon the recording mode so that said supplying means is driven to reduce a difference between a head temperature at a start of a scan and the head temperature at an end of the scan when the second recording mode is selected.

11. A terminal of a computer, comprising:

means for performing computer operations; and an ink jet recording apparatus for recording an image by using a recording head to emit an ink by a heat generation of an electrothermal transducer, said apparatus performing recording onto a recording medium by relatively scanning said recording head and the recording medium, said apparatus comprising driving means for driving said recording head in a recording mode selected from a plurality of recording modes, said recording modes including a first recording mode, for performing normal recording on a sheet of the recording medium and a second recording mode, for recording different portions of a single image onto a plurality of sheets, respectively, of the recording medium, supplying means for supplying a non-ejection heating signal to said electrothermal transducer so as not to eject the ink, selecting means for selecting conditions for supplying said non-ejection heating signal by said supplying means depending upon the recording mode, and control means for controlling said supplying means in accordance with the conditions selected by said selecting means depending upon the recording mode so that said supplying means is driven to reduce a difference between a head temperature at a start of a scan and the head temperature at an end of the scan when the second recording mode is selected.

12. An ink jet recording apparatus, which when recording cooperates with an image means for supplying a signal to eject an ink so as to record a record image, in which said ink jet recording apparatus a recording head that is constructed by arranging in an arranging direction a plurality of ejecting portions each for ejecting the ink by a heat generation of an electrothermal transducer is repetitively scanned in a direction different from the arranging direction of the ejecting portions, thereby recording the record image having a boundary portion caused by the scanning, comprising:

supplying means for supplying a non-ejection heating signal to said electrothermal transducer so as not to eject the ink;

selecting means for selecting conditions for supplying said non-ejection heating signal supplied from said supplying means;

correcting means for correcting by a correction amount an amount of ink that is ejected to the boundary portion of the record image formed onto the recording medium by the scan; and control means for controlling said correcting means in the scanning, according to the conditions for supplying the non-ejection heating signal selected by said selecting means, the control means thereby controlling the correction amount so that a particular amount of ink is applied.

13. An apparatus according to claim 12, wherein said control means allows said supplying means to supply said non-ejection heating signal when the image recording is not executed.

14. An apparatus according to claim 12, wherein said control means allows said supplying means to supply said non-ejection heating signal to an ejecting portion which does not eject the ink when the image is recorded.

15. An apparatus according to claim 12, wherein said control means allows said supplying means to supply said non-ejection heating signal for a period of time during which said recording head is returned.

16. An apparatus according to claim 12, wherein said recording head ejects inks of a plurality of colors.

17. An apparatus according to claim 12, further comprising conveying means for conveying a recording medium that is recorded by said recording head.

18. An apparatus according to claim 12, wherein said boundary portion is a portion including a record ending position at the end of a main scan and a record starting position at the start of a main scan.

19. An apparatus according to claim 12, further comprising recording mode means for recording in a recording mode by combining a plurality of output images to form a final output image, and said selecting means selects the conditions for supplying the non-ejection heating signal in accordance with whether the recording mode is executed.

20. A copying machine, comprising:

copying means for copying; and an ink jet recording apparatus, which when recording cooperates with an image means for supplying a signal to eject an ink so as to record a record image, in which said ink jet recording apparatus a recording head that is constructed by arranging in an arranging direction a plurality of ejecting portions each for ejecting the ink by a heat generation of an electrothermal transducer is repetitively scanned in a direction different from the arranging direction of the ejecting portions, thereby recording the record image having a boundary portion caused by the scanning, said apparatus comprising supplying means for supplying a non-ejection heating signal to said electrothermal transducer so as not to eject the ink, selecting means for selecting conditions for supplying said non-ejection heating signal supplied from said supplying means, correcting means for correcting by a correction amount an amount of ink that is ejected to the boundary portion of the record image formed onto the recording medium by the scan, and control means for controlling said correcting means in the scan, according to the conditions for supplying the non-ejection heating signal selected by said selecting means, the control means thereby controlling the correction amount so that a particular amount of ink is applied.

21. A facsimile apparatus, comprising:

facsimile means for performing facsimile operations; and an ink jet recording apparatus, which when recording cooperates with an image means for supplying a signal to eject an ink so as to record a record image, in which said ink jet recording apparatus a recording head that is constructed by arranging in an arranging direction a plurality of ejecting portions each for ejecting the ink by a heat generation of an electrothermal transducer is repetitively scanned in a direction different from the arranging direction of the ejecting portions, thereby recording the record image having a boundary portion caused by the scanning, said ink jet recording apparatus comprising supplying means for supplying a non-ejection heating signal to said electrothermal transducer so as not to eject the ink, selecting means for selecting conditions for supplying said non-ejection heating signal supplied from said supplying means, correcting means for correcting by a correction amount an amount of ink that is ejected to the boundary portion of the record image formed onto the recording medium by the scan, and control means for controlling said correcting means in the scan, according to the conditions for supplying the non-ejection heating signal selected by said selecting means, the control means thereby controlling the correction amount so that a particular amount of ink is applied.

22. A terminal of a computer, comprising:

means for performing computer operations; and an ink jet recording apparatus, which when recording cooperates with an image means for supplying a signal to eject an ink so as to record a record image, in which said ink jet recording apparatus a recording head that is constructed by arranging in an arranging direction a plurality of ejecting portions each for ejecting the ink by a heat generation of an electrothermal transducer is repetitively scanned in a direction different from the arranging direction of the ejecting portions, thereby recording the record image having a boundary portion caused by the scanning, said apparatus comprising supplying means for supplying a non-ejection heating signal to said electrothermal transducer so as not to eject the ink, selecting means for selecting conditions for supplying said non-ejection heating signal supplied from said supplying means, correcting means for correcting by a correction amount an amount of ink that is ejected to the boundary portion of the record image formed onto the recording medium by the scan, and control means for controlling said correcting means in the scan, according to the conditions for supplying the non-ejection heating signal selected by said selecting means, the control means thereby controlling the correction amount so that a particular amount of ink is applied.

23. An ink jet recording method of recording an image by using a recording head to emit an ink by a heat generation of an electrothermal transducer to record onto a recording medium by relatively scanning the recording head and the recording medium, said method comprising:

a step of selecting a one of a plurality of recording modes, the recording modes including a first recording mode, for performing normal recording on a sheet of the recording medium and a second recording mode, for recording different portions of a single image onto a plurality of sheets, respectively, of the recording medium;

a setting step of setting conditions for supplying a non-ejection heating signal to the electrothermal transducer so as not to eject the ink depending upon the recording mode selected in said selecting step;

a non-ejection heating signal supplying step of supplying the non-ejection heating signal to the electrothermal transducer in accordance with the conditions set in said setting step to reduce a difference between a head temperature at a start of a scan and the head temperature at an end of the scan when the image recording is not executed; and an ejecting signal supplying step of supplying an ejecting signal to the electrothermal transducer so as to eject the ink when the image is recorded, said ejecting signal supplying step following said non-ejection heating signal supplying step.

24. A method according to claim 23, wherein said second recording mode is a mode for combining a plurality of output images to form a final output image, and in said setting step, said conditions are set in accordance with whether said second recording mode is executed.

25. An ink jet recording method wherein a recording apparatus cooperates with an image means for supplying a signal to eject an ink so as to record a record image and a recording head that is constructed by arranging in an arranging direction a plurality of ejecting portions each for ejecting an ink by a heat generation of an electrothermal transducer is repetitively scanned in a direction different from the arranging direction of said ejecting portions, thereby recording a record image caused by the scanning, comprising:

a setting step of setting conditions for supplying a non-ejection heating signal to said electrothermal transducer so as not to eject the ink;

a correcting step of correcting an ejection amount of ink to be ejected to a boundary portion of the image to be formed onto the recording medium by said scanning based on a correction amount selected according to said conditions for supplying the non-ejection heating signal set in said setting step;

a non-ejection heating signal supplying step of supplying said non-ejection heating signal to said electrothermal transducer in accordance with said conditions set in said setting step; and an ejecting signal supplying step of supplying an ejecting signal to the electrothermal transducer to eject the ink when the image is recorded, said ejecting signal supplying step following said non-ejection heating signal supplying step.

26. A method according to claim 25, wherein in said non-ejection heating signal supplying step, said non-ejection heating signal is supplied to said electrothermal transducer when the image recording is not executed.

27. A method according to claim 25, wherein in said non-ejection heating signal supplying step, said non-ejection heating signal is supplied to said electrothermal transducer for an ejecting portion which ejects no ink when the image is recorded.

28. An method according to claim 25, further comprising a step of recording in a recording mode by combining a plurality of output images to form a final output image, and in said setting step, the conditions are set in accordance with whether the recording mode is executed.

29. A recording apparatus for recording an image on a recording medium by scanning a recording head, comprising:

driving means for performing recording in a recording mode selected from a plurality of recording modes, said recording modes including a first mode for performing recording such that a portion of an image recorded at an end of scanning and a portion of an image recorded at a beginning of scanning may be recorded as portions of a continuous image, and a second mode for performing recording such that a portion of an image recorded at an end of scanning and a portion of an image recorded at a beginning of scanning may be recorded as portions of a non-continuous image; and control means for performing control for adjustment of a temperature of the recording head to reduce a difference between the temperature at a start of a scan and the temperature at an end of the scan when the first recording mode is selected.

* * * * *

UNITED STATES PATENT AND TRADEMARK OFFICE

CERTIFICATE OF CORRECTION

PATENT NO. : 6,511,159 B1
DATED : January 28, 2003
INVENTOR(S) : Akio Suzuki et al.

It is certified that error appears in the above-identified patent and that said Letters Patent is hereby corrected as shown below:

Column 12,
Line 28, “a state” should be deleted.

Column 14,
Line 61, “is” should read -- in --.

Column 20,
Line 60, “An” should read -- A --.

Signed and Sealed this

Second Day of December, 2003

JAMES E. ROGAN
*Director of the United States Patent and Trademark Office*